US007396298B2

(12) United States Patent
Jertson et al.

(10) Patent No.: US 7,396,298 B2
(45) Date of Patent: Jul. 8, 2008

(54) GOLF CLUB HEAD WITH REINFORCED CROWN

(75) Inventors: Marty R. Jertson, Phoenix, AZ (US); Eric V. Cole, Phoenix, AZ (US)

(73) Assignee: Karsten Manufacturing Corporation, Phoenix, AZ (US)

( * ) Notice: Subject to any disclaimer, the term of this patent is extended or adjusted under 35 U.S.C. 154(b) by 115 days.

(21) Appl. No.: 11/496,216

(22) Filed: Jul. 31, 2006

(65) Prior Publication Data

US 2008/0026870 A1 Jan. 31, 2008

(51) Int. Cl.
*A63B 53/04* (2006.01)

(52) U.S. Cl. ..... 473/346; 473/345

(58) Field of Classification Search ..... None
See application file for complete search history.

(56) References Cited

U.S. PATENT DOCUMENTS

| | | | | |
|---|---|---|---|---|
| 4,214,754 | A * | 7/1980 | Zebelean | 473/346 |
| 4,432,549 | A * | 2/1984 | Zebelean | 473/346 |
| 4,681,321 | A | 7/1987 | Chen et al. | |
| 5,067,715 | A | 11/1991 | Schmidt | |
| 5,180,166 | A * | 1/1993 | Schmidt et al. | 473/332 |
| 5,213,328 | A * | 5/1993 | Long et al. | 473/346 |
| 5,351,958 | A * | 10/1994 | Helmstetter | 473/346 |
| 5,419,559 | A * | 5/1995 | Melanson et al. | 473/346 |
| 6,595,871 | B2 | 7/2003 | Sano | |
| 6,645,087 | B2 * | 11/2003 | Yabu | 473/342 |
| 6,783,465 | B2 * | 8/2004 | Matsunaga | 473/329 |
| 6,852,038 | B2 * | 2/2005 | Yabu | 473/224 |
| 7,250,007 | B2 * | 7/2007 | Lu | 473/329 |
| 2003/0114244 | A1 | 6/2003 | Matsunaga | |

FOREIGN PATENT DOCUMENTS

JP 2001-95957 4/2001

* cited by examiner

*Primary Examiner*—Alvin A Hunter
(74) *Attorney, Agent, or Firm*—Darrell F. Marquette; John D. Titus

(57) ABSTRACT

A golf club head with a front wall, a rear wall and a reinforced crown includes ribs in the crown that are spaced more closely together near the front wall than near the rear wall. Preferably, the ribs radiate from a point in space located forward of the front wall. This arrangement of ribs significantly increases the fundamental structural frequency of the club head and significantly reduces the peak stress in the crown of the club head when compared with ribs extending perpendicular to the front wall and parallel to each other.

19 Claims, 3 Drawing Sheets

GOLF CLUB HEAD WITH REINFORCED CROWN

BACKGROUND OF THE INVENTION

The present invention generally relates to golf equipment and, more particularly, to golf club heads.

Modern wood-type golf club heads are now almost exclusively made of metal rather than the persimmon wood that gave the clubs their name. These club heads are generally constructed as a hollow metal shell with a relatively thick face to withstand the ball impact and a relatively thick sole to withstand grazing impact with the ground as well as lowering the center of gravity of the club head. The remainder of the club head is manufactured as thin as possible so as to allow the maximum amount of material to be dedicated to the face and sole portions. Although the crown and skirt of a modern club head are quite thin, they still must be sufficiently rigid in the direction of the maximum stress in order to provide support for the face of the club head.

Ribs have commonly been employed in the crowns of club heads to enable the crowns to be as lightweight as possible while still providing sufficient stiffness in the fore and aft direction. U.S. Pat. No. 4,214,754 to Zebelean discloses a hollow club head with a crown that includes parallel ribs running perpendicular to the face of the club head that extend internally and bridge the thin transition with the crown. Similarly, U.S. Pat. No. 6,595,871 to Sano discloses a hollow club head with a separately attached face and a crown that includes a plurality of parallel ribs extending perpendicular to the face. U.S. Pat. No. 5,067,715 to Schmidt et al discloses a hollow club head that includes a crown with a plurality of parallel ribs that merge into and run perpendicularly to the club head face as well as a plurality of ribs that merge into and run perpendicularly to a rear wall of the club head.

The prior art fails to recognize is that a club head having a crown with parallel ribs that uniformly reinforce the face of the club head is not an efficient structure since the club head face is not uniformly loaded but is subjected to essentially a point impact near its center.

SUMMARY OF THE INVENTION

The present invention provides a hollow metal body having a heel end, a toe end, a crown, a sole, a front wall and a skirt. The skirt extends between the heel and toe ends forming a rear wall. The crown has an upper surface and a lower surface. A plurality of narrow, elongate, generally straight, metallic, shock wave distributing ribs extend downward from the lower surface of the crown. Each rib of the plurality of ribs extends from a first end proximal the front wall to a second end proximal the rear wall. The ribs are spaced apart by a greater amount at their second ends than at their first ends. In the preferred embodiment, adjacent ribs are spaced apart at least 20% greater at their second ends than at their first ends and adjacent ribs diverge from their first ends to their second ends by an angle of at least 5 degrees. The first ends of the ribs are spaced from the front wall and the second ends of the ribs are spaced from the rear wall. The ribs have longitudinal axes that radiate from and intersect at a point located forward of the front wall.

The inventors of the present invention discovered that a golf club head with a crown having ribs spaced more closely together near the front wall, preferably radiating from a point in space forward of the front wall, significantly increased the fundamental structural frequency of the club head and significantly reduced the peak stress in the crown when compared with parallel ribs extending perpendicular to the front wall as in the prior art.

DESCRIPTION OF THE INVENTION

Figure 1:
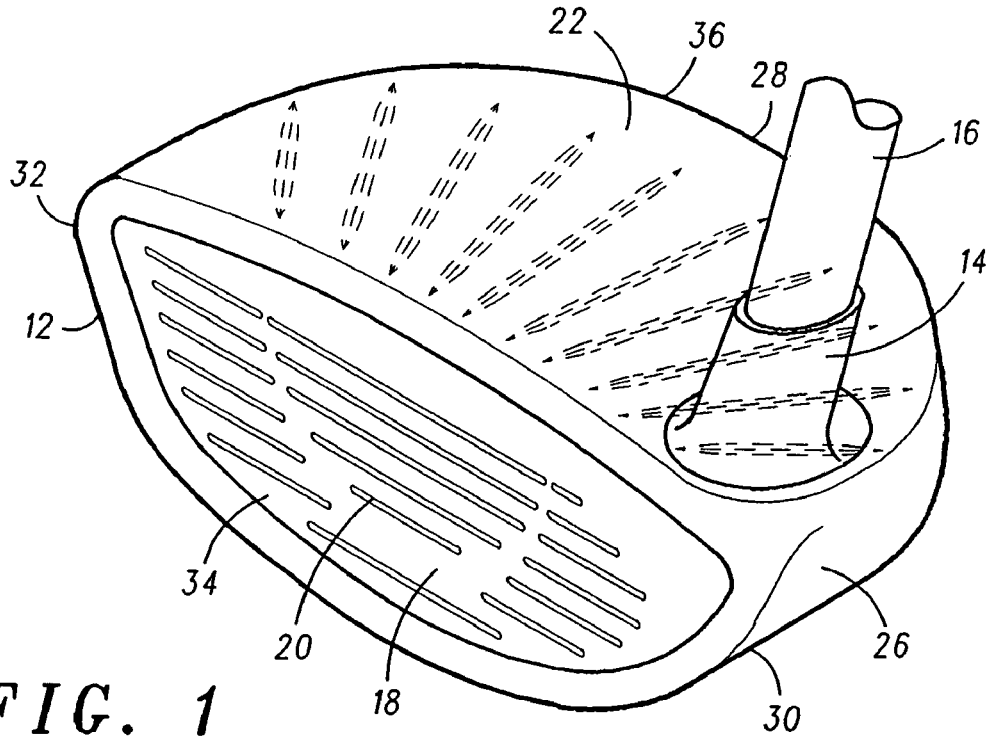
FIG. 1 is a front perspective view of a golf club head incorporating features of the present invention.
Figure 3:
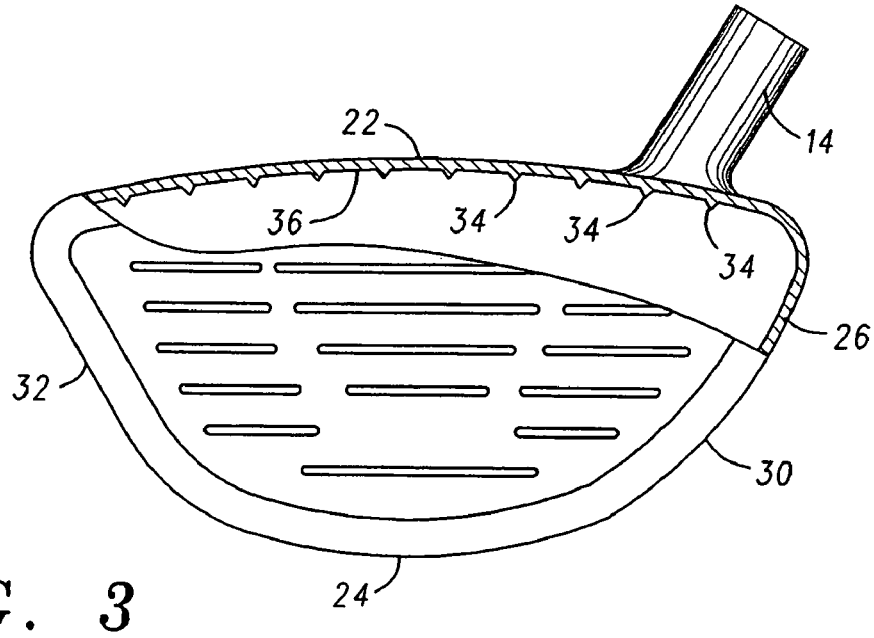
FIG. 3 is a partial cross-sectional view of the club head of FIG. 1 viewed from the front.
Figure 2:
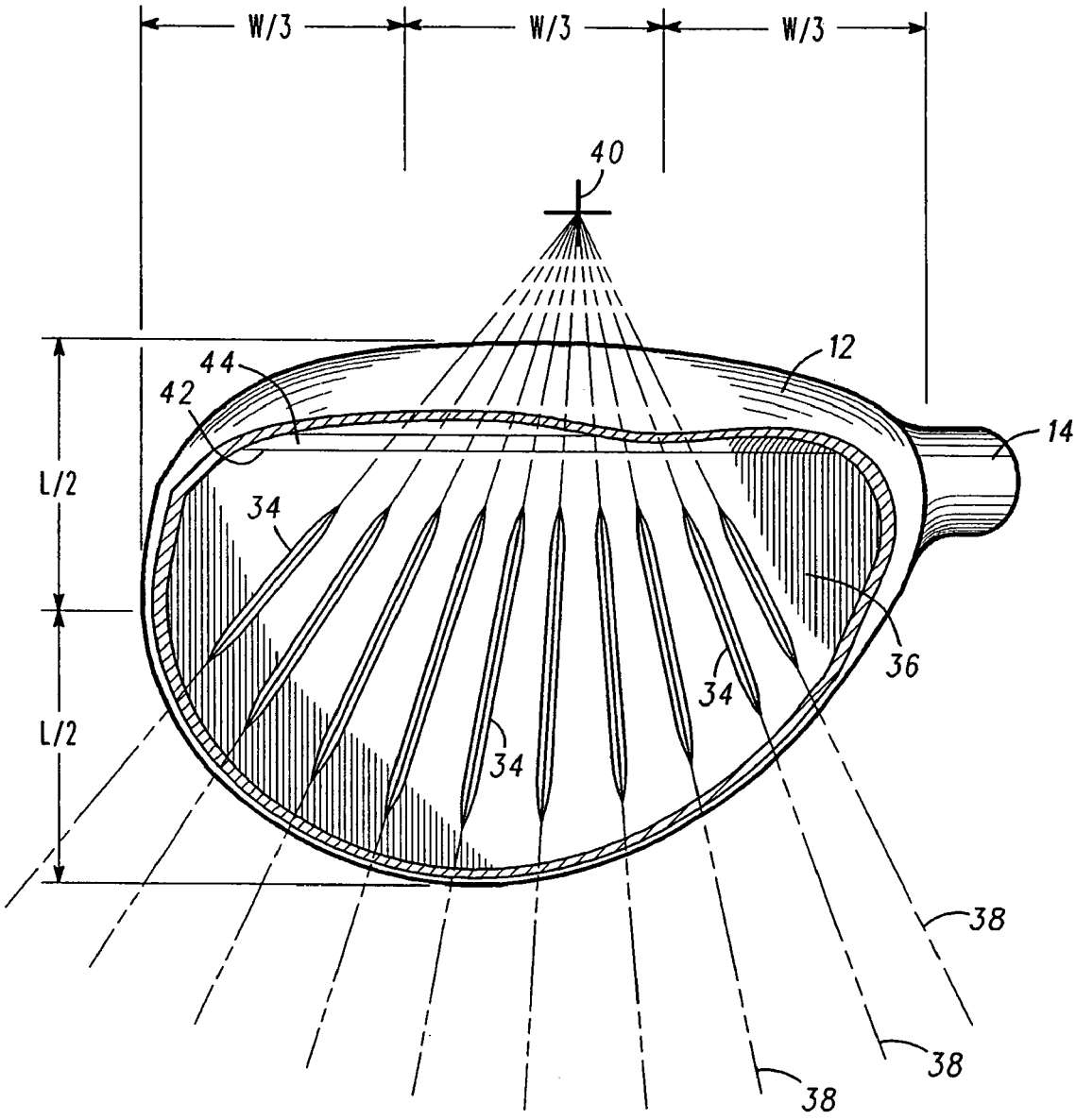
FIG. 2 is a cross-sectional view of the club head of FIG. 1 viewed from below.

With reference to FIGS. 1-3, golf club 10 comprises a club head 12, a hosel 14 and a shaft 16. Club head 12 is composed of a hollow body 18, typically made of stainless steel, titanium or other material having a high shear modulus of elasticity and high strength-to-weight ratio. Hollow body 18 comprises a front wall or face 20 adapted for impacting a golf ball. Hollow body 18 further comprises a top wall or crown 22, a bottom wall or sole 24, and a side wall or skirt 26 that connects the face 20 to crown 22 and sole 24. Club head 12 further includes a heel end 30 and a toe end 32. Skirt 26 wraps around the club head 12 between the heel and toe ends 30, 32 to form a rear wall 28.

Crown 22 comprises a thin walled structure preferably cast as part of hollow body 18. Crown 22 is preferably titanium having a relatively thin thickness dimension of 0.030 inch±0.005 inch. Crown 22 is reinforced with a plurality of ribs 34 extending downward from lower surface 36 of crown 22. Each rib 34 extends from a first end proximal, but spaced from, the front wall 20 to a second end proximal, but spaced from, the rear wall 28. The ribs 34 are spaced apart by a greater amount, preferably 20% greater, at their second ends than at their first ends. Adjacent ribs 34 diverge from their first ends toward their second ends by an angle of at least 5 degrees. Ribs 34 comprise narrow, elongate, generally straight, metallic, shock wave distributing elements with a height dimension of 0.020 inch±0.005 inch and width dimension of 0.070 inch±0.005 inch. Ribs 34 are generally convex downward when viewed in cross-section and blend smoothly into lower surface 36 of crown 22. It will be understood that crown 22 is free of ribs extending transversely between the ribs 34.

The lower surface 36 of the crown 22 has a forward portion and a rearward portion as defined by a midline lying generally parallel to the front wall 20 one-half the distance between a forwardmost point on the front wall 20 and a rearwardmost point on the rear wall 28. The first ends of the ribs 34 terminate in the forward portion of the crown 22 and the second ends of the ribs 34 terminate in the rearward portion of the crown 22.

As shown most clearly in FIG. 2, ribs 34 are arrayed in a pattern such that the longitudinal axes 38 of the ribs 34 radiate from and intersect at a point 40 in space located forward of front wall 20. Point 40 is preferably located within the middle one third (W/3) of the width of front wall 20 and is preferably located substantially in front of the center line of front wall 20. Note that because club head 12 is a three dimensional body, as used herein, point 40 refers to a single point when viewed in plan view as in FIG. 2. Alternatively, point 40 can be thought of as a vertical line consisting of the locus of intersections of vertical planes passing through the center lines of the ribs 34.

Ribs 34 originate at a first location proximal the intersection 42 of the rear surface 44 of front wall 20 and lower surface 36 of crown 22 and extend to a second location proximal rear wall 28. In the illustrative embodiment, at least half, and preferably all of the ribs 34 extend from front wall 20 past the mid-point (L/2) of club head 12 and are not interconnected by any transverse ribs. Accordingly, each rib 34 acts independently of the other ribs 34 interconnected only by the intervening thin section of crown 22 therebetween. Preferably, point 40 is also no more than L/2 forward of front wall 20. This results in a pattern of ten ribs 34 subtending an angle of approximately 60 degrees or an angular divergence of from 4 to 8 degrees, preferably about 6 degrees of divergence between adjacent ribs 34.

Figure 4:
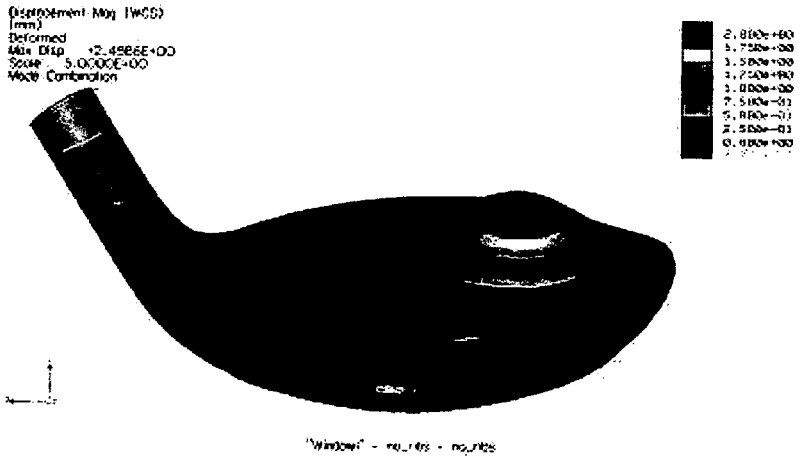
FIG. 4 is a representation of maximum deflection and peak stresses in a golf club head having a crown structure with no reinforcing ribs.
Figure 5:
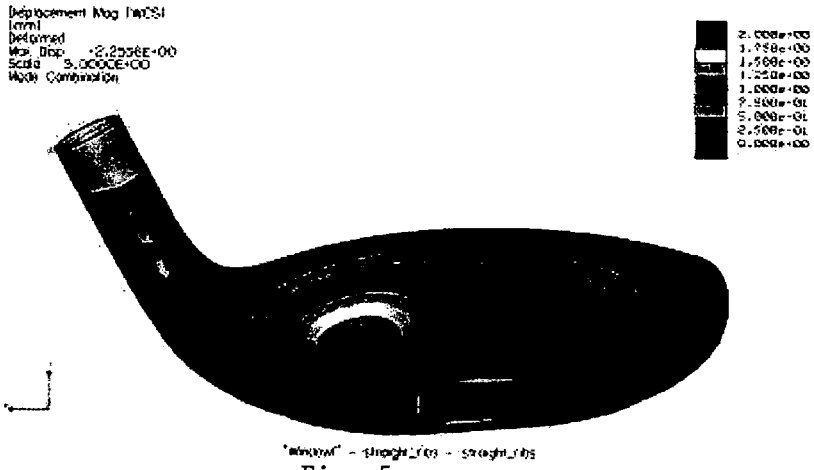
FIG. 5 is a representation of maximum deflection and peak stresses in a golf club head having traditional perpendicular ribs.
Figure 6:
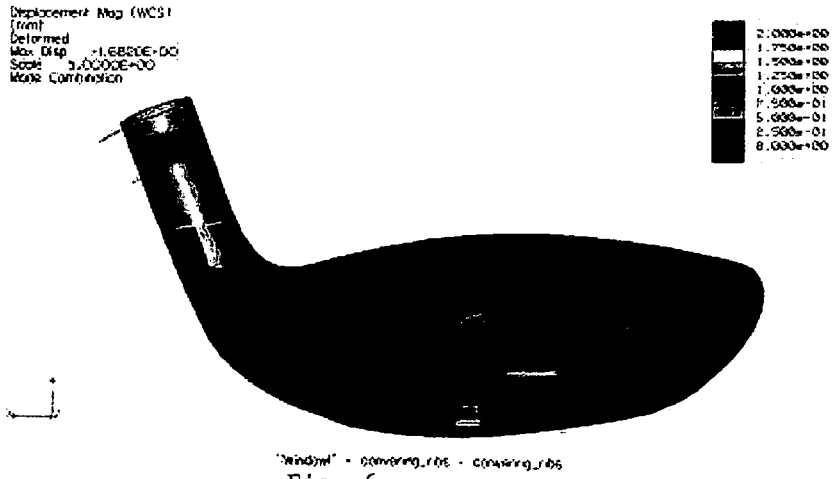
FIG. 6 is a representation of maximum deflection and peak stresses in a golf club head having a crown structure with radially extending ribs in accordance with a feature of the present invention.

As shown in FIGS. 4-6, the surprisingly result of this arrangement of ribs 34 is that although an array of perpendicular ribs 0.020 inch high by 0.070 inch wide (FIG. 5) results in only a 9% reduction in maximum stress as compared with unreinforced crown region (FIG. 4), ribs 34 arranged in a radial fan pattern in accordance with the present invention (FIG. 6) reduce maximum stress in the crown region by almost 36%. Although not wishing to be held to any particular theory of operation, it is believed that because the face 20 itself deforms non-uniformly extending outward from the point of impact, the loads are transferred to the crown region in a similar non-uniform manner radiating outward from the point of impact. Therefore, arranging the ribs 34 in a radial pattern extending out from near the point of impact yields a crown 22 that more efficiently supports the face 20 during impact.

Although certain illustrative embodiments and methods have been described herein, it will be apparent from the foregoing disclosure to those skilled in the art that variations and modifications of such embodiments and methods may be made without departing from the spirit and scope of the invention. Accordingly it is intended that the invention should be limited only to the extent required by the appended claims and the rules and principles of applicable law.

What is claimed is:

1. A golf club head comprising:

a hollow metal body having a heel end, a toe end, a crown, a sole, a front wall and a skirt, said skirt extending between said heel and toe ends forming a rear wall, said crown having an upper surface and a lower surface;

a plurality of narrow, elongate, generally straight, metallic, shock wave distributing ribs extending downward from said lower surface of said crown, each rib of said plurality of ribs extending from a first end proximal said front wall to a second end proximal said rear wall, said ribs being spaced apart by a greater amount at said second ends than at said first ends;

each rib of said plurality of ribs having a longitudinal axis; and at least three of said longitudinal axes radiating from and intersecting at a point forward of said front wall.

2. The golf club head of claim 1, wherein:

adjacent ribs are spaced apart at least 20% greater at said second ends than at said first ends.

3. The golf club head of claim 1, wherein:

adjacent ribs diverge from said first ends toward said second ends by an angle of at least 5 degrees.

4. The golf club head of claim 1, wherein:

said crown is free of ribs extending transversely between said plurality of ribs.

5. The golf club head of claim 1, wherein:

said first end of each rib is spaced from said front wall and said second end of each rib is spaced from said rear wall.

6. The golf club head of claim 1, wherein:

said lower surface of said crown has a forward portion and a rearward portion as defined by a midline lying generally parallel to the front wall one-half the distance between a forwardmost point on the front wall and a rearwardmost point on the rear wall, wherein the first ends of said ribs terminate in said forward half and the second ends of said ribs terminate in said rearward half.

7. The golf club head of claim 1, wherein:

all of said longitudinal axes radiate from and intersect at said point.

8. A golf club head comprising:

a hollow metal body having a heel end, a toe end, a crown, a sole, a front wall and a skirt, said skirt extending between said heel and toe ends forming a rear wall, said crown having an upper surface and a lower surface;

a plurality of narrow, elongate, generally straight, metallic, shock wave distributing ribs extending downward from said lower surface of said crown, each rib of said plurality of ribs extending from a first end proximal said front wall to a second end proximal said rear wall, said ribs being spaced apart by a greater amount at said second ends than at said first end; and said plurality of ribs comprising at least eight ribs having longitudinal axes radiating from and intersecting at a point forward of said front wall.

9. The golf club head of claim 8, wherein adjacent ribs are spaced apart at least 20% greater at said second ends than at said first ends.

10. The golf club head of claim 8, wherein adjacent ribs diverge from said first ends toward said second ends by an angle of at least 5 degrees.

11. The golf club head of claim 8, wherein said crown is free of ribs extending transversely between said plurality of ribs.

12. The golf club head of claim 8, wherein said first end of each rib is spaced from said front wall and said second end of each rib is spaced from said rear wall.

13. The golf club head of claim 8, wherein said lower surface of said crown has a forward portion and a rearward portion as defined by a midline lying generally parallel to the front wall one-half the distance between a forwardmost point on the front wall and a rearwardmost point on the rear wall, and wherein the first ends of said ribs terminate in said forward half and the second ends of said ribs terminate in said rearward half.

14. A golf club head comprising:

a hollow metal body having a heel end, a toe end, a crown, a sole, a front wall and a skirt extending between said heel and toe ends forming a rear wall, said crown having an upper surface, a lower surface and a thickness dimension; and a plurality of narrow, elongate, metallic, shock wave distributing ribs extending downward from said lower surface of said crown, each rib of said plurality of ribs extending from a first location proximal said front wall to a second location proximal said rear wall, at least three ribs of said plurality of ribs having longitudinal axes that radiate from and intersect at a point located forward of said front wall.

15. The golf club head of claim 14, wherein:

each rib of said plurality of ribs has a width dimension and wherein said ribs are spaced apart transversely from each other by a distance greater than said width dimension.

16. The golf club head of claim 14, wherein:

each rib of said plurality of ribs has a width dimension and a height dimension wherein said height dimension is less than the thickness dimension of said crown.

17. The golf club head of claim 14, wherein:

said ribs have a generally downwardly convex cross-section that blends smoothly into the lower surface of said crown.

18. The golf club head of claim 14, wherein:

said ribs have a first end proximal said front wall and a second end proximal said rear wall, said first end is tapered and spaced from said front wall, and said second end is tapered and spaced from said rear wall.

19. The golf club head of claim 14, wherein:

each rib of said plurality of ribs has a longitudinal axis that radiates from and intersects said point.

* * * * *